US006014877A

United States Patent [19]

Shen

[11] Patent Number: 6,014,877

[45] Date of Patent: Jan. 18, 2000

[54] CORE RETAINER FOR A LOCK WITH AN INTERCHANGEABLE LOCK CORE

[76] Inventor: Mu-Lin Shen, No. 32, Lane 76, Fu-An Road, Sec. 5, Tainan, Taiwan

[21] Appl. No.: 09/246,375

[22] Filed: Feb. 8, 1999

[51] Int. Cl.[7] ..... E05B 9/04

[52] U.S. Cl. ..... 70/371; 70/224; 70/DIG. 39; 70/369

[58] Field of Search ..... 70/223, 224, 367–371, 70/215, 216, DIG. 39

[56] References Cited

U.S. PATENT DOCUMENTS

| | | | |
|---|---|---|---|
| 4,444,034 | 4/1984 | Best et al. | 70/371 X |
| 4,995,249 | 2/1991 | Preissler et al. | 70/369 X |
| 5,398,531 | 3/1995 | Shen | 70/371 X |
| 5,507,163 | 4/1996 | Juang | 70/369 |
| 5,605,064 | 2/1997 | Katayama et al. | 70/370 X |
| 5,752,399 | 5/1998 | Shen | 70/371 X |
| 5,813,260 | 9/1998 | Widen | 70/371 X |
| 5,927,777 | 7/1999 | Kuo et al. | 70/224 X |

*Primary Examiner*—Suzanne Dino Barrett
*Attorney, Agent, or Firm*—Alan Kamrath; Oppenheimer, Wolff & Donnelly, LLP

[57] ABSTRACT

An outside handle assembly includes comprises a spindle, a knob connected to the spindle to rotate therewith, and a core retainer. The spindle includes an upper slot and a lower slot, thereby defining two lateral walls. Each lateral wall includes an upper cut defined in an upper side thereof and a lower cut defined in an underside thereof. The knob includes an end wall having an opening defined therein and a projection formed in a periphery that defines the opening. The core retainer is mounted in the spindle and includes a cylindrical main body including a first end with a flange formed on an outer periphery thereof and a second end. The flange includes an outer end face that bears against the end wall of the knob. Two retainer lips are formed on the outer end face of the flange and include a cut therebetween for fittingly receiving the projection of the knob to thereby prevent rotational movement of the knob relative to the core retainer. The core retainer further includes an insert received in one of the upper slot and the lower slot of the spindle. The insert includes two lugs extended beyond the second end of the cylindrical main body. The lugs are received in the upper or lower cuts of the spindle to prevent the lock core from being pulled outwardly in the axial direction.

2 Claims, 5 Drawing Sheets

CORE RETAINER FOR A LOCK WITH AN INTERCHANGEABLE LOCK CORE

BACKGROUND OF THE INVENTION

1. Field of the Invention

The present invention relates to a core retainer for a lock of the type having an interchangeable lock core to securely position an outside knob of the lock in place, thereby allowing rapid and easy change of the interchangeable lock core. The core retainer also may provide an anti-pulling effect to the lock core by means of securely engaging the core retainer with a spindle of the lock.

2. Description of the Related Art

U.S. Pat. No. 5,752,399 to Shen issued on May 19, 1998 discloses a reversible core retainer such that the key used to unlock a door needs not be inverted due to different handing of door. A problem still exists in the lock of the type having an interchangeable lock core removably mounted in an outside knob of the lock. It is found that the knob rotates freely through a small angle in either direction when it is turned, i.e., the knob is not securely retained in place. As a result, replacement of a new interchangeable lock core is difficult as the figure "8" hole of the knob cannot be precisely aligned with the longitudinal hole of the spindle for easy insertion of the lock core. In addition, the core retainer can be easily pulled out along with the lock core in the axial direction, as the engaging strength between the core retainer and the lock core is relatively weak. The present invention is intended to provide an improved core retainer that securely engages with the outside knob to retain the outside knob in place and that provides a reliable anti-pulling effect to the lock core by means of securely engaging the core retainer with the spindle of the lock.

SUMMARY OF THE INVENTION

It is a primary object of the present invention to provide an improved core retainer that securely engages with the outside knob of a lock to prevent rotational movement of the outside knob, thereby allowing easy replacement of the interchangeable lock core in the outside knob.

It is another object of the present invention to provide an improved core retainer that securely engages with the spindle of the lock to prevent axial movement of the core retainer and to prevent the spindle from being twisted when the outside knob is turned.

It is a further object of the present invention to provide an improved core retainer that securely engages with the spindle of the lock to prevent the lock core from being pulled outwardly in the axial direction.

The present invention provides an outside handle assembly that comprises a spindle, a knob connected to the spindle to rotate therewith, and a core retainer. The spindle includes an upper slot and a lower slot, thereby defining two lateral walls. Each lateral wall includes an upper cut defined in an upper side thereof and a lower cut defined in an underside thereof. The knob includes an end wall having an opening defined therein and a projection formed in a periphery that defines the opening.

The core retainer is mounted in the spindle and includes a cylindrical main body including a first end with a flange formed on an outer periphery thereof and a second end. The flange includes an outer end face that bears against the end wall of the knob. Two retainer lips are formed on the outer end face of the flange and include a cut therebetween for fittingly receiving the projection of the knob to thereby prevent rotational movement of the knob relative to the core retainer. The core retainer further includes an insert received in either the upper slot or the lower slot of the spindle according to the door handing. The insert includes two lugs extended beyond the second end of the cylindrical main body. The lugs are received in the upper cuts of the spindle when the insert is received in the upper slot of the spindle. The lugs are received in the lower cuts of the spindle when the insert is received in the lower slot of the spindle.

Each lateral wall of the spindle includes an upper taper defined in an upper side of an end thereof that is enclosed in the knob and a lower taper defined in a lower side of the end thereof to assist in mounting of the core retainer to the spindle.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
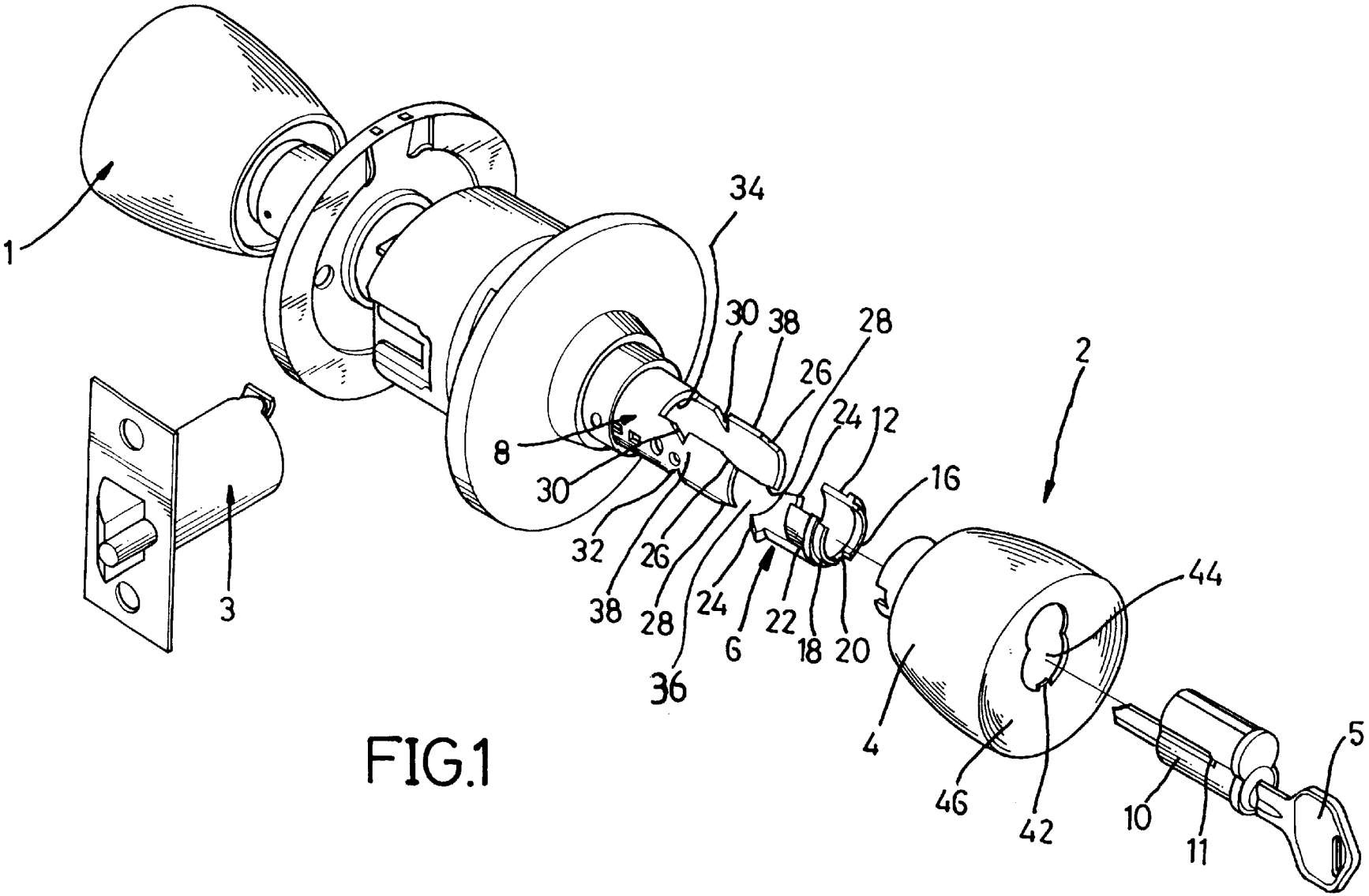
FIG. 1 is an exploded perspective view of a lock in accordance with the present invention.

Referring to the drawings and initially to FIG. 1, a lock in accordance with the present invention generally includes an inside handle assembly 1, an outside handle assembly 2, and a latch assembly 3. The outside handle assembly 2 includes a spindle 8, a core retainer 6, a knob 4 connected to the spindle 8 to rotate therewith, and a lock core 10. The spindle 8 includes an upper slot 34 and a lower slot 36, thereby defining two lateral walls 38. Each lateral wall 38 includes an upper taper 26 defined in an upper side of an end thereof that is enclosed in the knob 4 and a lower taper 28 defined in a lower side of the end thereof. Each lateral wall 38 further includes an upper cut 30 defined in an upper side thereof and a lower cut 32 defined in an underside thereof.

Figure 2:
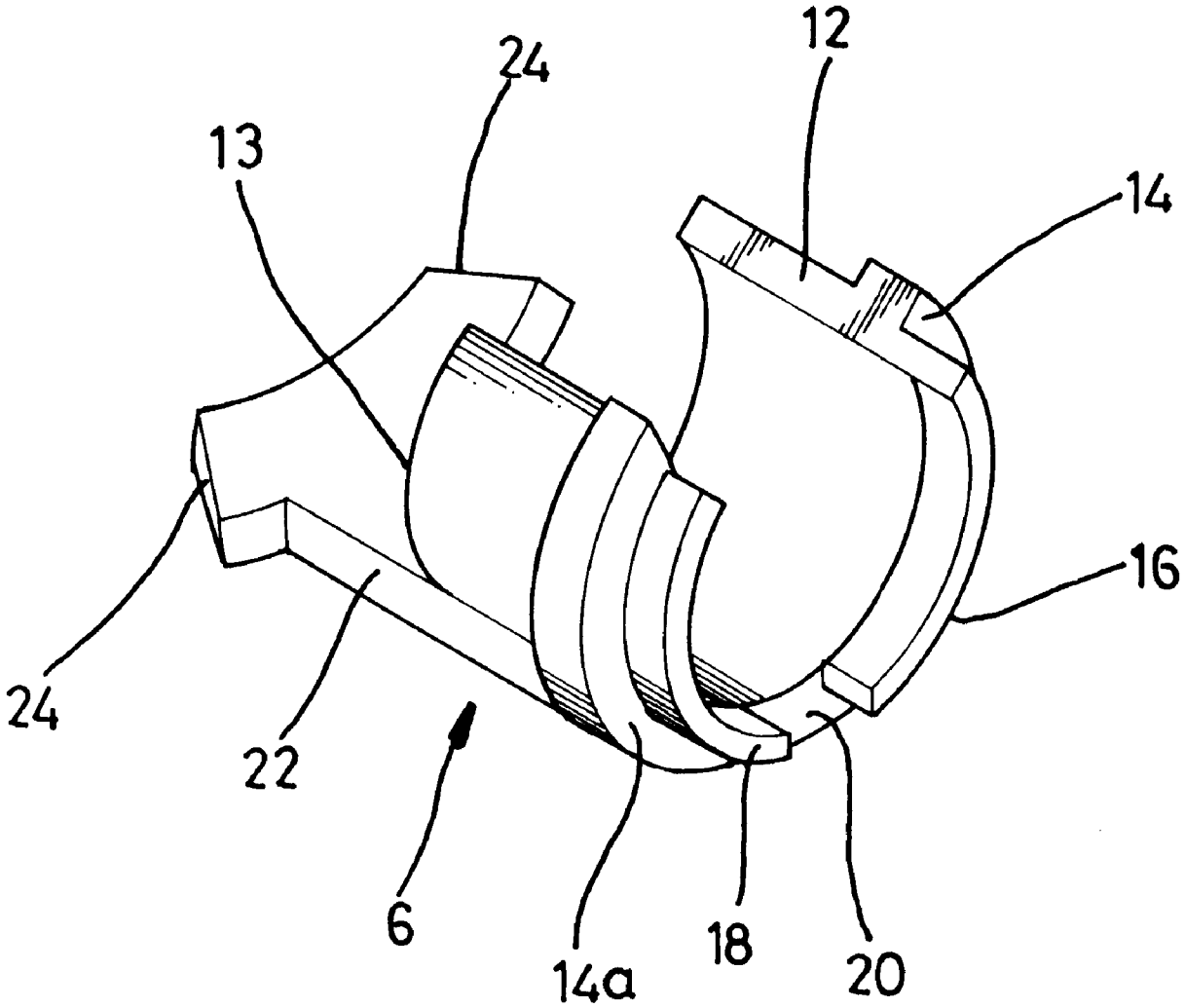
FIG. 2 is an enlarged perspective view of a core retainer in accordance with the present invention.

Still referring to FIG. 1, the knob 4 includes a figure "8" opening 44 in an end wall 46 thereof and a projection 42 formed in a periphery that defines the figure "8" opening 44. Referring to FIG. 2, the core retainer 6 includes a cylindrical main body 12 with a flange 14 formed on an outer periphery of a first end thereof. Two retainer lips 16 and 18 are formed on an outer end face 14*a* of the flange 14 and include a cut 20 therebetween. The core retainer 6 further includes an insert 22 extended from the first end thereof toward a second end thereof The insert 22 extends beyond the second end of the cylindrical main body 12 and includes two lugs 24 formed on each of two sides of a distal end thereof. Referring to FIG. 1, the lock core 10 includes a lug 11 that is operable by a control key 5 to project and be blocked by a rear end face 13 of the second end of the cylindrical main body 12 to prevent from outward movement of the lock core 10 by axial pull.

Figure 3:
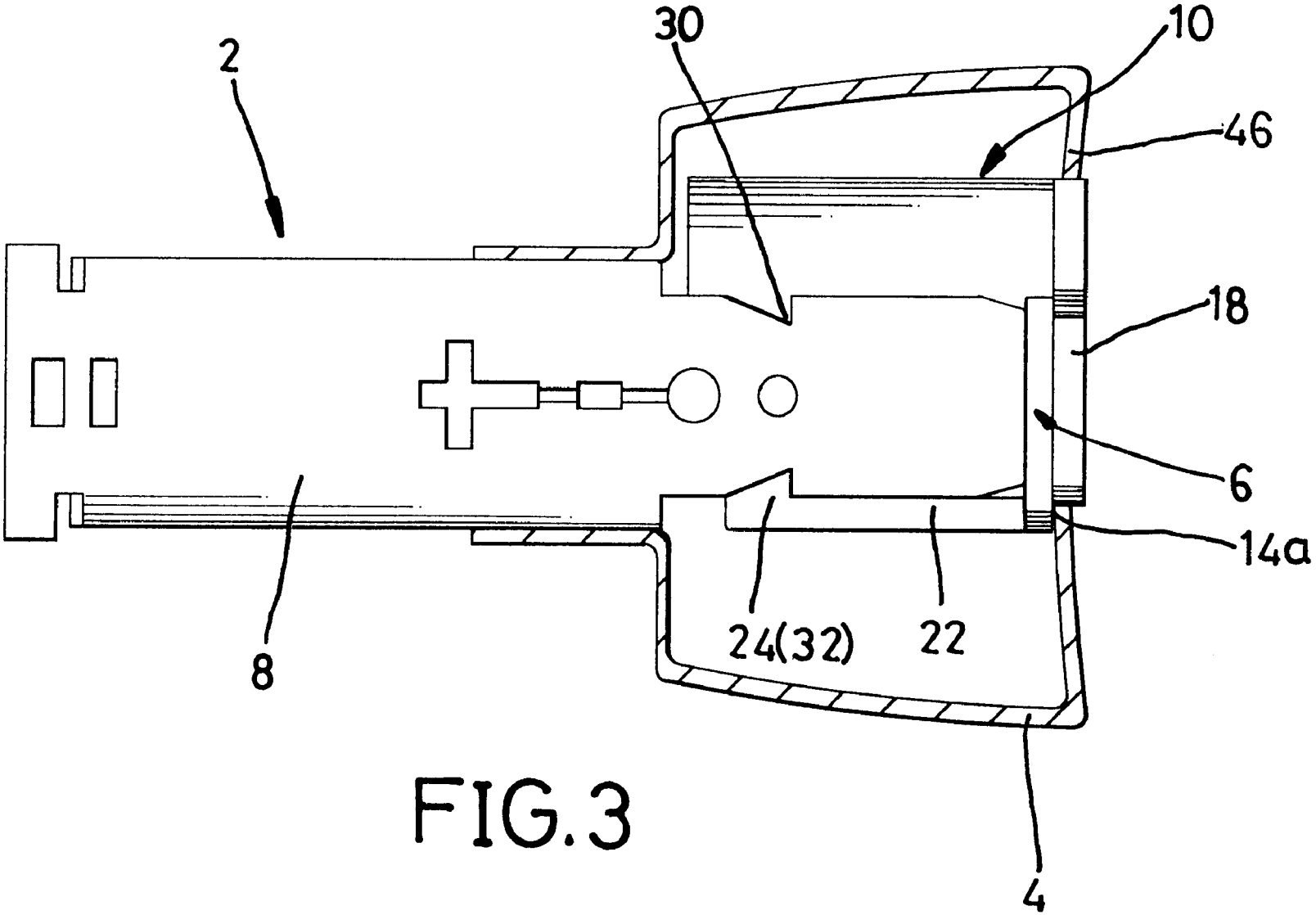
FIG. 3 is a plan view, partially sectioned, illustrating interconnection of an interchangeable lock core with a rear end face of the core retainer.
Figure 4:
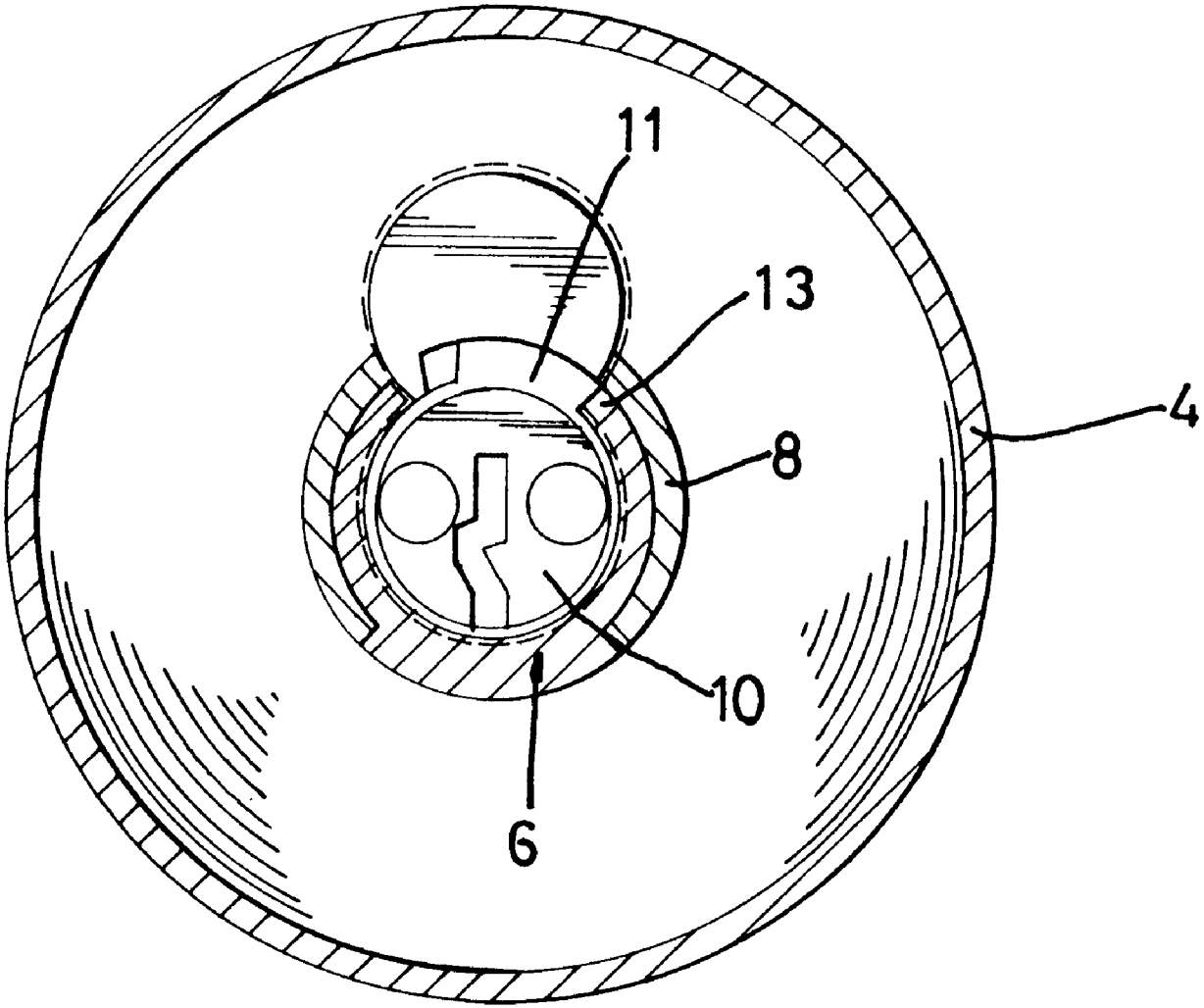
FIG. 4 is a sectional view taken along line 4—4 in FIG. 3.

Referring to FIG. 1, when mounting the core retainer 6 to the spindle 8, the core retainer 6 is slid along, e.g., the lower tapers 28 in an inclined manner until the lugs 24 approach a position below the lower cuts 32. The core retainer 6 is then moved upwardly to move the lugs 24 into the lower cuts 32, while the insert 22 is fittingly received in the lower slot 36 of the spindle 8, as shown in FIG. 3. Removal of the core retainer 6 can be achieved by means of forcibly removing the lugs 24 from the lower cuts 32 by a tool and sliding the core retainer 6 along the lower tapers 28 in a reverse direction. For a door of a different handing, the core retainer 6 is slid along the upper tapers 26 until the lugs 24 approach a position above the upper cuts 30. The core retainer 6 is then moved downwardly to move the lugs 24 into the upper cuts 30, while the insert 22 is fittingly received in the upper slot 34 of the spindle 8. Thus, the key cuts of an authentic key always face upwardly for unlocking. The knob 4 is then attached to enclose a part of the spindle 8 and the core retainer 6. As can be seen from FIG. 3, the outer end face 14*a* of the flange 14 bears against the end wall 46 of the knob 4, while the projection 42 is fittingly received in the cut 20 between the retainer lips 16 and 18, as shown in FIG. 5.

Figure 5:
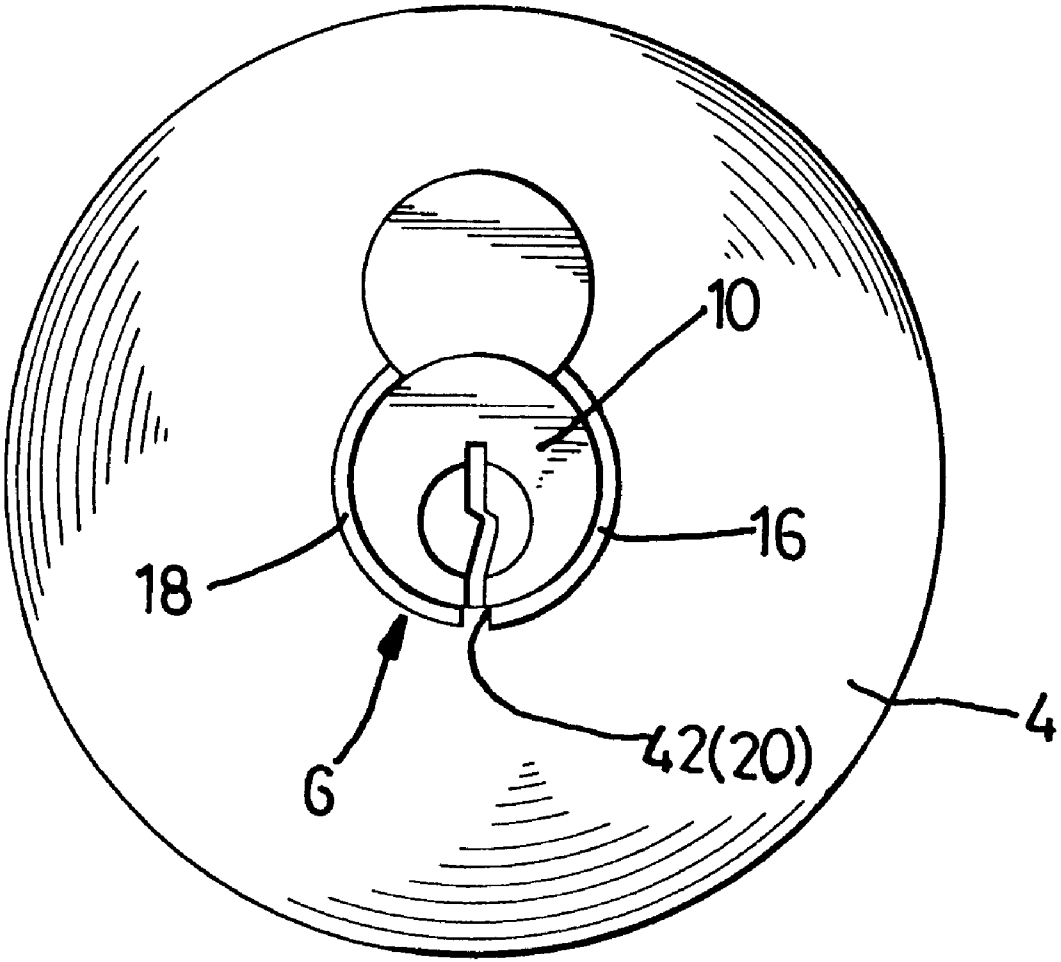
FIG. 5 is a front view of the outside handle of the lock.

Referring to FIG. 5, rotational movement of the knob 4 relative to the core retainer 6 is prevented due to provision of the projection 42 fittingly received in the cut 20 and the arrangement of the retainer lips 16 and 18. More specifically, when the knob 4 is turned, both retainer lips 16 and 18 are stopped by the projection 42. Thus, removal and replacement of the interchangeable lock core 10 can be easily achieved. In addition, axial movement of the lock core 10 is prevented, as the lugs 24 of the core retainer 6 are received in the cuts 30 or 32, and the lug 11 of the lock core 10 is retained by the rear end face 13 of the core retainer 6. Thus, damage to the lock core 10 by axial pull is prevented. In addition, although the structural strength of the spindle 8 is reduced as a result of provision of the slots 34 and 36, the insert 22 of the core retainer 6 fills one of the slots 34 or 36, while the lock core 10 is held between the lateral walls 38 of the spindle 8. This prevents the spindle 8 from being twisted when the knob 4 is turned.

Although the invention has been explained in relation to its preferred embodiment, it is to be understood that many other possible modifications and variations can be made without departing from the spirit and scope of the invention as hereinafter claimed.

What is claimed is:

1. An outside handle assembly of a lock, comprising:

a spindle including an upper slot and a lower slot, thereby defining two lateral walls, each said lateral wall including an upper cut defined in an upper side thereof and a lower cut defined in an underside thereof;

a knob connected to the spindle to rotate therewith, the knob including an end wall having an opening defined therein and a projection formed in a periphery that defines the opening; and a core retainer mounted in the spindle and including a cylindrical main body including a first end with a flange formed on an outer periphery thereof and a second end, the flange including an outer end face that bears against the end wall of the knob, two retainer lips being formed on the outer end face of the flange and including a cut therebetween for fittingly receiving the projection of the knob to thereby prevent rotational movement of the knob relative to the core retainer, the core retainer further including an insert received in one of the upper slot and the lower slot of the spindle according to door handing, the insert including two lugs extended beyond the second end of the cylindrical main body, wherein the lugs are received in the upper cuts of the spindle when the insert is received in the upper slot of the spindle, and wherein the lugs are received in the lower cuts of the spindle when the insert is received in the lower slot of the spindle.

2. The outside handle assembly as claimed in claim 1, wherein each said lateral wall of the spindle includes an upper taper defined in an upper side of an end thereof that is enclosed in the knob and a lower taper defined in a lower side of the end thereof to assist in mounting of the core retainer to the spindle.

* * * * *